US009282815B2

(12) United States Patent
Bunch

(10) Patent No.: US 9,282,815 B2
(45) Date of Patent: Mar. 15, 2016

(54) STORAGE SYSTEM

(71) Applicant: DROPOUT CABINET FIXTURES, LLC, Morgan Hill, CA (US)

(72) Inventor: Clinton Merle Bunch, Morgan Hill, CA (US)

(73) Assignee: DROPOUT CABINET FIXTURES, LLC, Morgan Hill, CA (US)

( * ) Notice: Subject to any disclaimer, the term of this patent is extended or adjusted under 35 U.S.C. 154(b) by 0 days.

(21) Appl. No.: 14/291,414

(22) Filed: May 30, 2014

(65) Prior Publication Data

US 2015/0250306 A1 Sep. 10, 2015

Related U.S. Application Data

(66) Continuation-in-part of application No. 13/590,387, filed on Aug. 21, 2012, now Pat. No. 8,777,338, Substitute for application No. 61/685,915, filed on Mar. 27, 2012.

(51) Int. Cl.

| | |
|---|---|
| ***A47F 5/08*** | (2006.01) |
| ***A47B 46/00*** | (2006.01) |
| ***A47B 77/10*** | (2006.01) |
| ***A47B 51/00*** | (2006.01) |

(52) U.S. Cl.

CPC ..... *A47B 46/005* (2013.01); *A47B 51/00* (2013.01); *A47B 77/10* (2013.01); *A47F 5/08* (2013.01)

(58) Field of Classification Search

CPC ..... A47F 5/08; A47B 46/005; A47B 51/00; A47B 77/10

USPC ..... 312/246, 247, 248, 319.1, 319.2, 319.3, 312/319.7, 272.5, 249.7, 325

See application file for complete search history.

(56) References Cited

U.S. PATENT DOCUMENTS

| | | | | | |
|---|---|---|---|---|---|
| 2,886,183 | A | * | 5/1959 | Crosby | 211/51 |
| 2,938,631 | A | * | 5/1960 | Brey | 211/90.01 |
| 3,431,040 | A | * | 3/1969 | Little et al. | 312/272 |
| 4,076,351 | A | * | 2/1978 | Wyant | 312/247 |
| 4,801,142 | A | * | 1/1989 | Friesen | 473/484 |
| 4,915,461 | A | * | 4/1990 | Kingsborough et al. | 312/247 |
| 5,058,846 | A | * | 10/1991 | Close | 248/284.1 |
| 5,127,721 | A | * | 7/1992 | Inden | 312/249.9 |
| 5,224,677 | A | * | 7/1993 | Close | 248/292.11 |
| 5,228,763 | A | * | 7/1993 | Gingold | 312/266 |
| 5,249,858 | A | * | 10/1993 | Nusser | 312/319.6 |
| 5,308,158 | A | * | 5/1994 | Vogelgesang et al. | 312/319.3 |
| 5,560,501 | A | * | 10/1996 | Rupert | 211/99 |
| 5,758,782 | A | * | 6/1998 | Rupert | 211/99 |
| 5,857,756 | A | * | 1/1999 | Fehre | 312/246 |

(Continued)

FOREIGN PATENT DOCUMENTS

JP 2002-223866 A 8/2002

*Primary Examiner* — James O Hansen

(74) *Attorney, Agent, or Firm* — Gordon Rees Scully Mansukhani LLP; Reid E. Dammann

(57) ABSTRACT

A storage system for storing contents is provided. The storage system includes a retractable vertical cabinet having a handle, at least a first and second pivoting support member pivotally attached to at least an exterior side of the retractable vertical cabinet and a support structure. The storage system further includes an electric actuator movement, a lift adjuster and a rotating adjustment screw threadably connected allowing for adjustment of a lift assist mechanism, which is connected to the first pivoting support member and the lift adjuster, to accommodate for varied loads.

10 Claims, 8 Drawing Sheets

(56) References Cited

U.S. PATENT DOCUMENTS

| | | | | |
|---|---|---|---|---|
| 5,934,615 | A * | 8/1999 | Treichler et al. | 244/118.5 |
| 6,231,138 | B1 * | 5/2001 | Janson | 312/201 |
| 6,247,771 | B1 * | 6/2001 | Miller | 312/310 |
| 7,922,268 | B2 * | 4/2011 | Weber | 312/246 |
| 8,303,053 | B2 * | 11/2012 | Bond et al. | 312/319.2 |
| 8,414,093 | B2 * | 4/2013 | Moran | 312/248 |
| 2002/0084732 | A1 * | 7/2002 | Steadman | 312/246 |
| 2008/0276551 | A1 * | 11/2008 | Thomas et al. | 52/173.1 |
| 2011/0266936 | A1 * | 11/2011 | Moran | 312/312 |

* cited by examiner

STORAGE SYSTEM

RELATED APPLICATIONS

This application is a continuation in part of U.S. Non-Provisional application Ser. No. 13/590,387 entitled "Storage System," filed on Aug. 21, 2012 and is now U.S. Pat. No. 8,777,338. This application is also a continuation in part of Patent Cooperation Treaty Application Serial No. PCT/US13/33908 entitled "Storage System," filed on Mar. 26, 2013. Both U.S. Ser. No. 13/590,387 and PCT/US13/33908 claim priority to U.S. Provisional Application No. 61/685,915, entitled "Lowering upper cabinet pull out apparatus," filed on Mar. 27, 2012. The contents of all related applications are hereby incorporated by reference in their entirety.

COPYRIGHT AUTHORIZATION

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

1) Field of the Invention

The present invention relates generally to a storage system. More particularly, the invention relates to a cabinet storage system for improving organization, accessibility and convenience of stored contents.

2) Discussion of the Related Art

Pull-out shelving systems and wall cabinet fillers are commonly used to store items such as spices, bottles, cans and boxes in small cabinet spaces. At times, users need to reach items in the upper portions of these systems and for most people this requires the use of a step stool or other elevating assistance. These methods are not only inadequate and inconvenient, but also hazardous.

The use of objects such as step stools to assist with reaching high items is inconvenient and cumbersome. In addition, some people use poles that extend to aid in reaching upper storage areas. These types of poles are difficult to use and dangerous given the risk of dropping stored items. Further, it is important to point out that the above objects take up valuable storage space. As such, a need in the art exists to provide the ability to access generally unused space or storage areas in unreachable or difficult to reach areas, without risk or need to store objects used for the same.

DETAILED DESCRIPTION OF THE INVENTION

Figure 1:
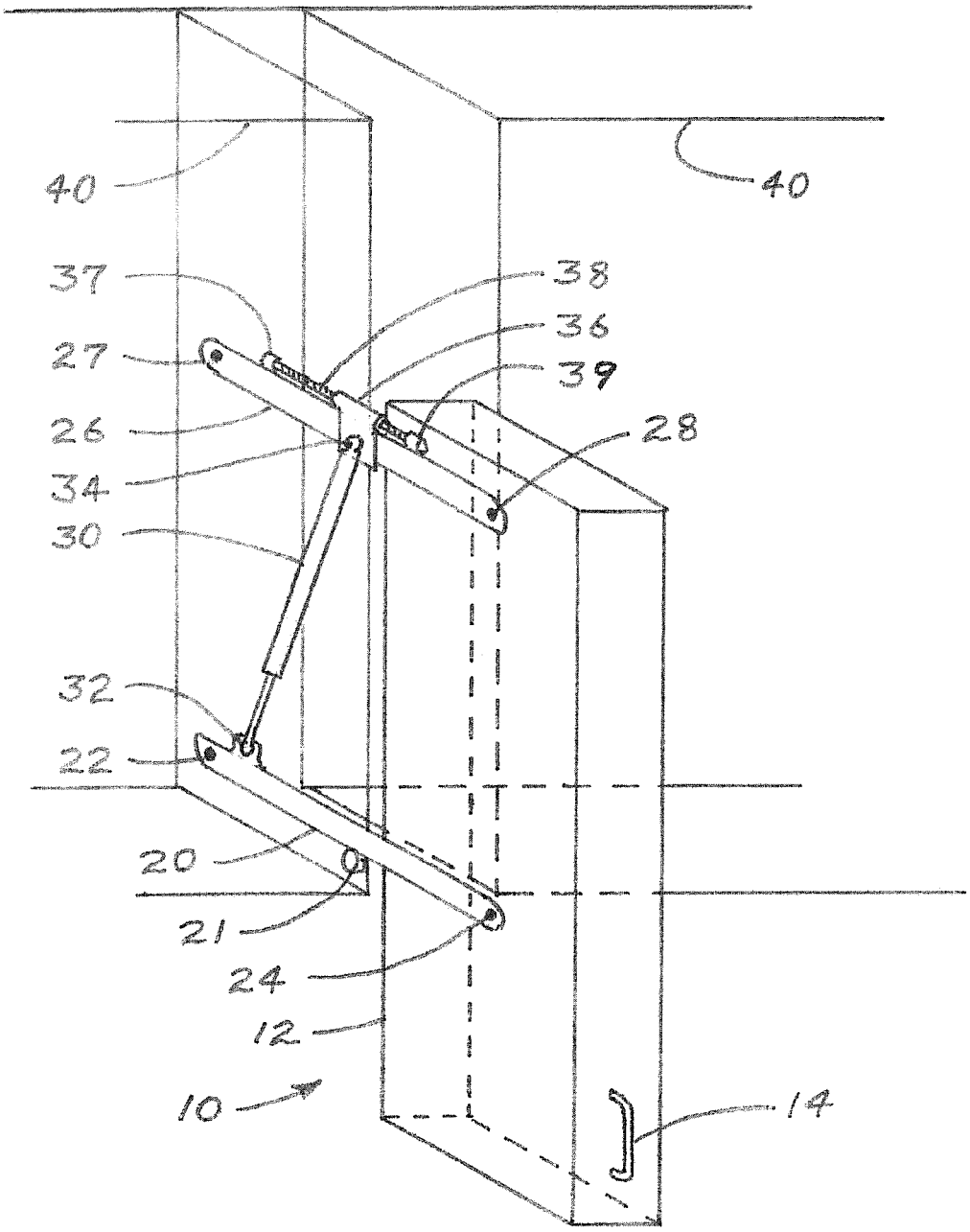
FIG. 1 is a front angled perspective view of an embodiment of a storage system in an open position.

Generally, the invention overcomes problems associated with the prior art by providing storage in areas generally out of reach to users. The invention provides that stored items in difficult to reach areas are made accessible by providing a structure that allows for a retractable vertical cabinet such that a variable height and extension can be achieved. This functionality allows movement in both the vertical and horizontal directions and provides the convenience and compactness needed in upper storage areas.

The invention can be made of a variety of materials including solid materials such as wood, metal (sheet metal) and/or plastic. Further, the construction can be made to any size without losing the advantages described herein. In an embodiment, the invention can be used from 3 to 6 inches wide more or less. However, as stated, functionality of the invention is not limited by size constraints.

The invention can be constructed in a variety of ways and still maintain the advantages outlined herein. In an embodiment, the invention can be suspended by two parallel pivoting support members. The pivoting support members can be made of any type of material that has sufficient strength and durability, including that mentioned herein. In an embodiment, the pivoting support members are attached to one side of a cabinet used for storing contents.

Aiding the retrieval of stored contents, in another embodiment, the pivoting support members are connected to a lift assist mechanism. The lift assist mechanism can include springs, cables, pneumatic boosters, hydraulic boosters or electric assist movement. The pivoting support members and lift assist mechanisms can be, in an embodiment, attached to the back, top and/or bottom of the retractable vertical cabinet such that the advantages outlined below are maintained.

In an embodiment, the electric actuator movement can include an electrical motor 50 wherein the electrical actuator is mounted to a fixed cabinet 40. The electric actuator movement includes a rotating threaded shaft 52, and is driven by motor 50 and rotates through swivel block 54 at arm 26. In an embodiment, the motor 50 is activated and electrically connected to a switch 56.

In the embodiment using a spring as the lift assist mechanism; the spring is able to store what is called mechanical energy in its construction. Springs are usually made out of spring steel, however some non-ferrous metals can also be used. Depending on the design and required operating environment, any material can be used to construct a spring, so long as the material has the required combination of rigidity and elasticity.

The invention generally moves outwardly and downward to allow easy access to items stored within the retractable vertical cabinet. In an embodiment, the invention may proceed downwardly. Additional benefits to the present invention are that it can be made to fit and function cleanly into custom cabinetry where space is limited. Therefore, not only does the invention allow for access to stored goods at distances difficult in reach, the storage system also is able to operate in very tight spaces and function to fit in with the design of any cabinetry.

When not pulled down and out, or in use, the invention may be held in a closed position by spring tension alone. The invention may also be held in a closed position by a retainer such as a latch, or the use of magnets causing retention. Thus, an advantage to the invention is that it may have additional security features such that the storage system is contained and secure.

Figure 2:
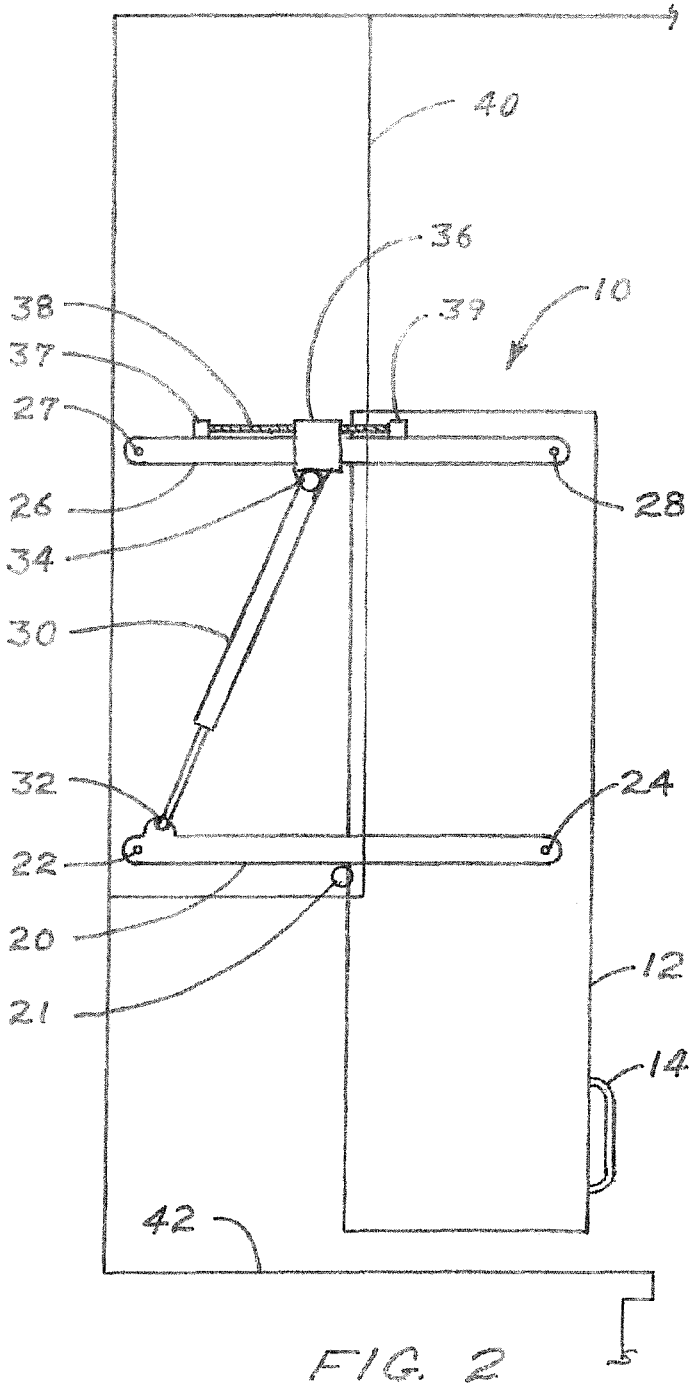
FIG. 2 is a side view of an embodiment of the storage system in an open position
Figure 3:
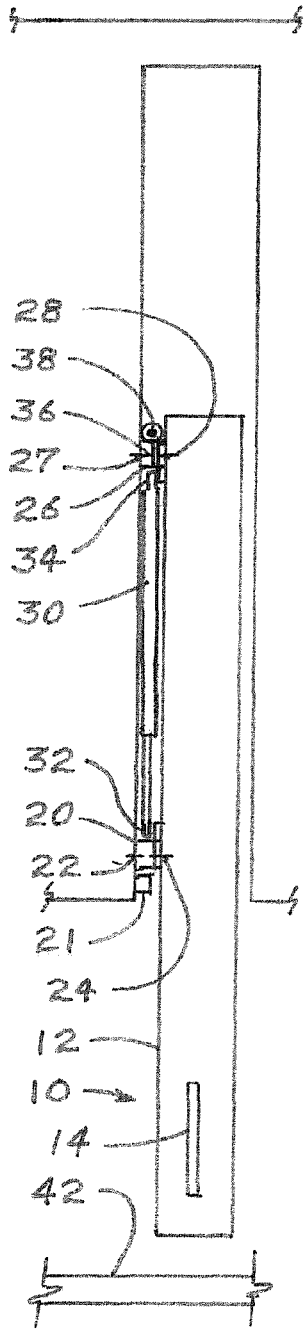
FIG. 3 is a front view of an embodiment of the storage system in the open position.
Figure 4:
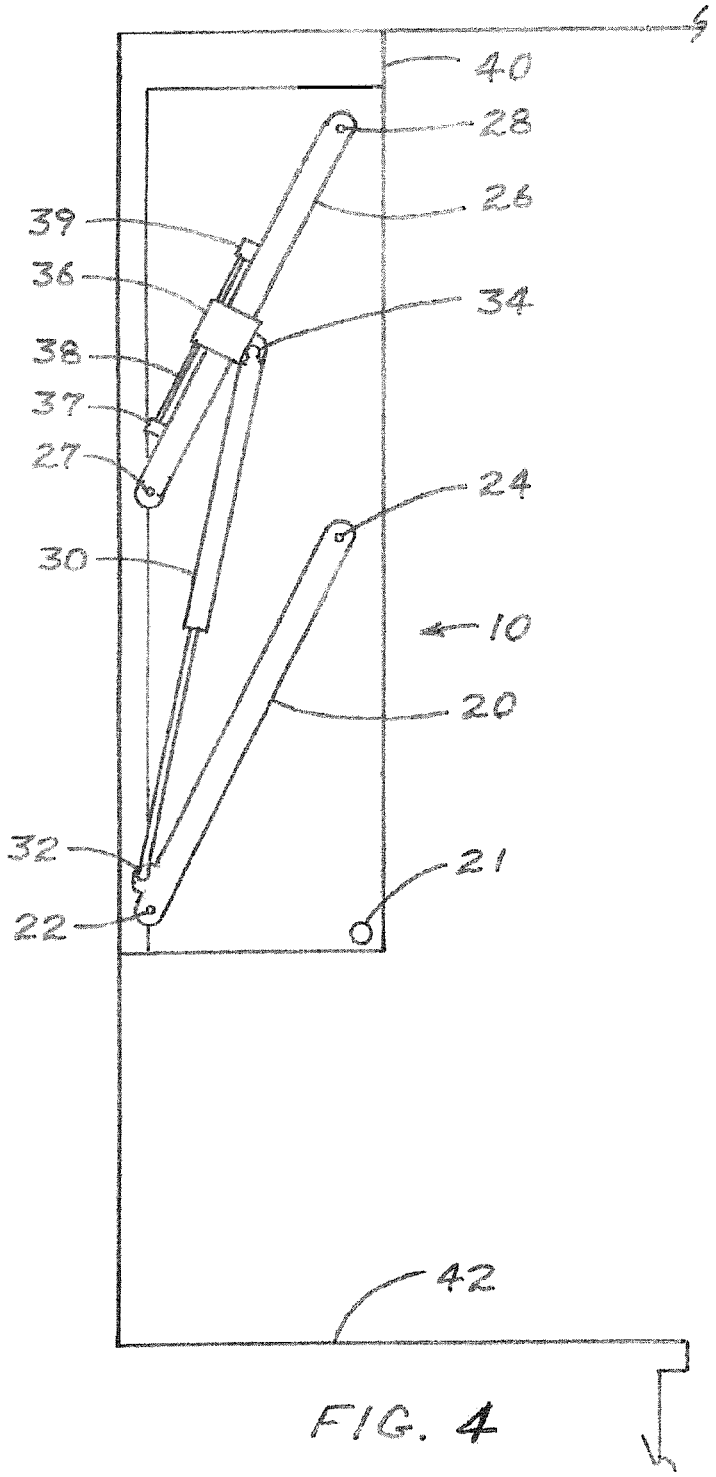
FIG. 4 is a side view of an embodiment of the storage system in a closed position.
Figure 5:
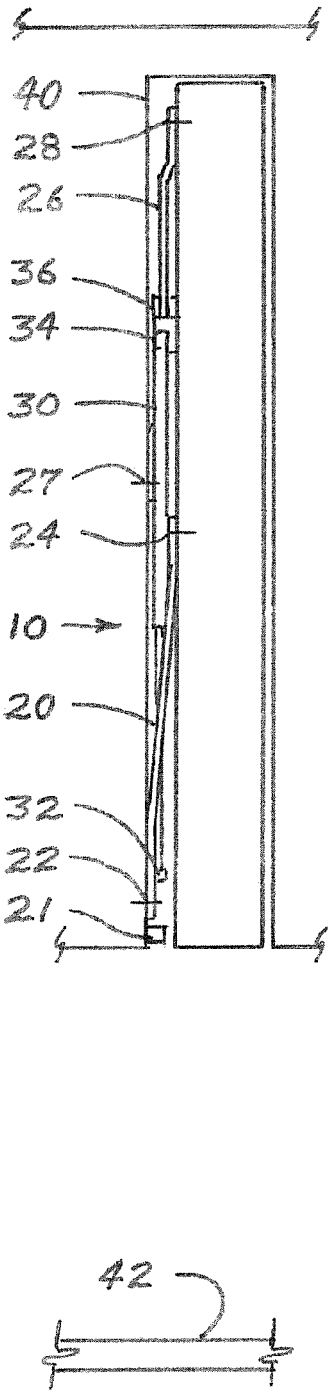
FIG. 5 is a front view of an embodiment of the storage system in the closed position.

FIGS. 1, 2 and 3 illustrate an embodiment of the storage system 10, in an open position, installed adjacent to standard wall cabinets 40. The storage system 10 is supported by a first and second pivoting support members, 20 and 26. The first and second pivoting support members, 20 and 26, respectively, are connected to a lift assist mechanism 30.

In an embodiment, the lift assist mechanism 30 can be a gas spring. A gas spring is a type of spring that uses a compressed gas contained in a cylinder, compressed by a piston, to exert a force. The gas spring can be adjustable push-in force or remote. It further can have a single touch release to allow full extension or the ability to lock it in a specific extended position.

The function of the lift assist mechanism 30 is to provide assistance in the range of motion for the storage system 10 such that the force exerted by the stored contents when the storage system 10 is in use, is tempered or reduced. It should be noted that any type of mechanism that provides or aids in lift assistance to counter the weight in contents can be used, as such the invention is not designed to be limiting in any way to gas or spring mechanisms.

FIGS. 1, 2 and 3 further illustrate a retractable vertical cabinet 12. The retractable vertical cabinet 12 includes an exterior and an interior formed by side walls. The interior can be comprised of any type of shelving configured for the items to be stored. As stated above, the retractable vertical cabinet 12 is not designed to be limited to any type of material or construction. Further, the size of the retractable vertical cabinet 12 can have varied dimensions and can otherwise depend on the space available and the specific application involved.

FIGS. 1-6 illustrate an embodiment, wherein the first and second pivoting support members, 20 and 26, attach to only one side of the retractable vertical cabinet 12 as installed within wall cabinet 40. In another embodiment, the first and second pivoting support members 20 and 26, are attached at a first end, either to a housing, foundation, support, or directly, to cabinets 40 at pivots 22 and 27 and to the retractable vertical cabinet 12 at pivot points 24 and 28 at a second end. The above embodiment allows for contents to be stored within the interior and otherwise be accessible to the user without having the pivoting support members, 20 and 26, as obstacles.

FIGS. 9-13 illustrate the a storage system in an open position using an electric actuator movement. As stated herein, the electric actuator movement can include the electrical motor 50 wherein the electrical actuator is mounted to the fixed cabinet 40. The electric actuator movement includes the rotating threaded shaft 52, and is driven by motor 50 and rotates through swivel block 54 at arm 26. In an embodiment, the motor 50 is activated and electrically connected to a switch 56.

Different constructions are available without departing from the advantages of the invention. In an embodiment, the invention can include a plurality of first and second pivoting support members which connect to a plurality of side walls of any retractable vertical cabinet 12. The type of construction and placement of the pivoting support members would depend on the construction of the retractable vertical cabinet 12 as well as the space being used.

The structure supporting the retractable vertical cabinet 12 includes a plurality of components. More clearly seen in FIG. 2, as stated above, the pivoting support members 20 and 26 are connected to the lift assist mechanism 30 at attachment points 32 and 34, and form the base for the support. Attachment points 32 and 34 can comprise any type of fastener such as a screw or bolt, as long as the connection allows for a pivot relationship between the two structures. In an embodiment, attachment point 34 is a part of a lift adjuster 36 which is adjustable on the first pivoting support member 26 by means of a rotating adjustment screw 38. The features and characteristics of the lift adjuster 36 are further described below.

FIGS. 1, 2 and 3 further illustrate a stop 21. The degree in which the retractable vertical cabinet 12 extends out and in an embodiment, down, is limited by the first and second pivoting support members 20 and 26, in an embodiment. The stop 21 prevents over extension, and in an embodiment, downward extension, of the retractable vertical cabinet 12 when pulled out, which would otherwise damage components of the storage system 10 or adjacent cabinetry. In an embodiment, the stop 21 is attached to either a housing or adjacent cabinet 40.

The stop 21 also performs a function as a guide. It assists with the alignment of the retractable vertical cabinet 12 when in use. Typically, the stop 21 can be made of rubber or plastic, however, other materials may be used such that when in contact with the first support member 20 integrity is maintained.

In an embodiment, the storage system 10 is manually operated by a handle 14 attached to the retractable vertical cabinet 12. However, any means can be used which allows a user to engage the retractable vertical cabinet 12 according to the movements discussed herein. These can include a variety and number of protrusions attached to the retractable vertical cabinet 12. Generally, this feature is determined by the end consumer's preference, as is the front trim panel to match cabinets 40 or the like.

FIG. 3 is a frontal view illustrating the retractable vertical cabinet 12 in the open position. In use, or in the open position, the user has pulled out the retractable vertical cabinet 12 by the handle 14, effectively activating the lift assist mechanism 30. The contents in the retractable vertical cabinet 12 operate as the load. In the spring embodiment of the lift assist mechanism 30, mechanism can be a coiled or torsion spring. The load then compresses (or stretches) the spring (in the case of a gas spring, the gas is compressed) on pulling down the retractable vertical cabinet 12. The force it exerts is proportional to its change in length.

An extension or compression spring has units of force divided by distance, for example lbf/in or N/m. Torsion springs have units of force multiplied by distance divided by angle, such as N·m/rad or ft·lbf/degree. In any event, the effect is the allowance of force in putting the storage system 10 in its closed position, illustrated in FIGS. 4 and 5.

As stated above, the lift assist mechanism 30 is connected to lift adjuster 36 at attachment point 34. The lift adjuster 36 is connected to a rotating adjustment screw 38. The rotating adjustment screw 38 is supported by a first and second idler , 37 and 39, respectively. The first and second idlers, 37 and 39, house and support the rotating adjustment screw 38. In an embodiment, the connection between the two structures is threaded. Further, in another embodiment, the first and second idlers, 37 and 39, are bonded or otherwise adhered to the second pivoting support member 26 to provide stability for movement of the same.

The lift adjuster 36 is moved by rotating adjustment screw 38. This movement effectively increases or decreases leverage against the lift assist mechanism 30. This movement provides versatility and allows the support structure to accommodate varying weight loads in the retractable vertical cabinet 12.

Figure 6:
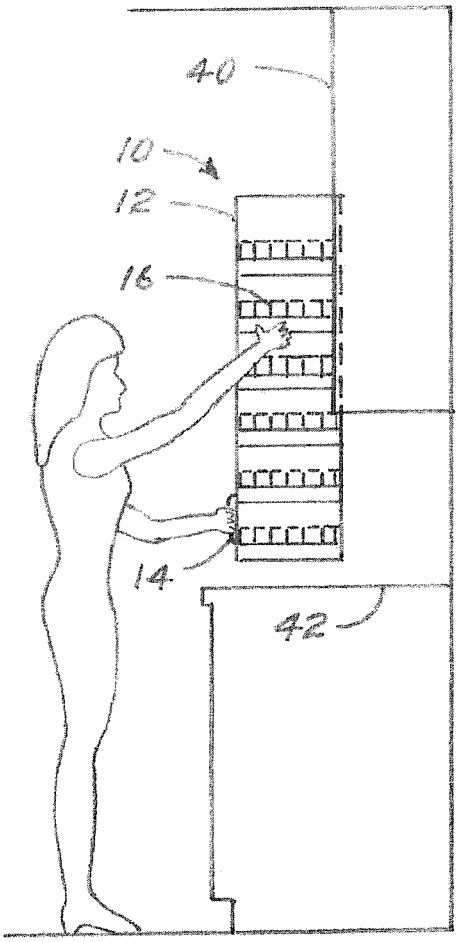
FIG. 6 is a side view of an embodiment of the storage system in an open position as it is used by a user.
Figure 7:
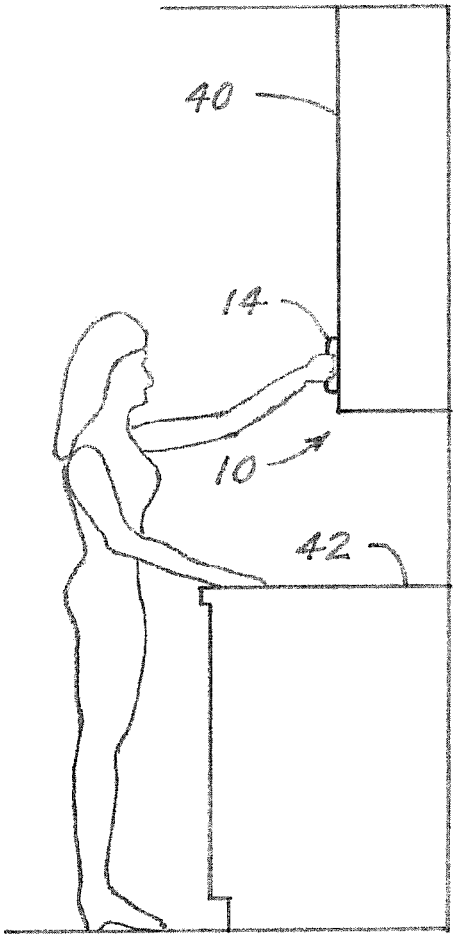
FIG. 7 is a side view of an embodiment of the storage system in a closed position as it is used by a user.
Figure 8:
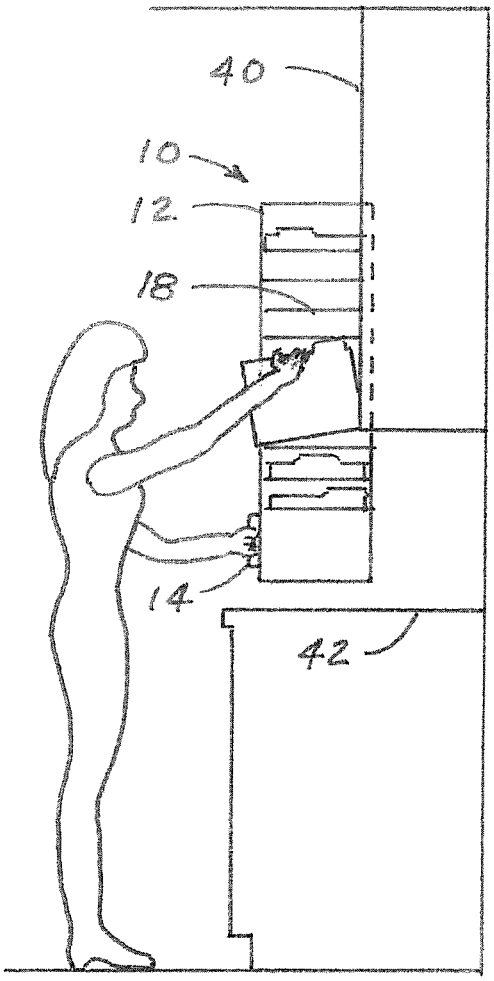
FIG. 8 is a side view of an alternative embodiment of the storage system.
Figure 9:
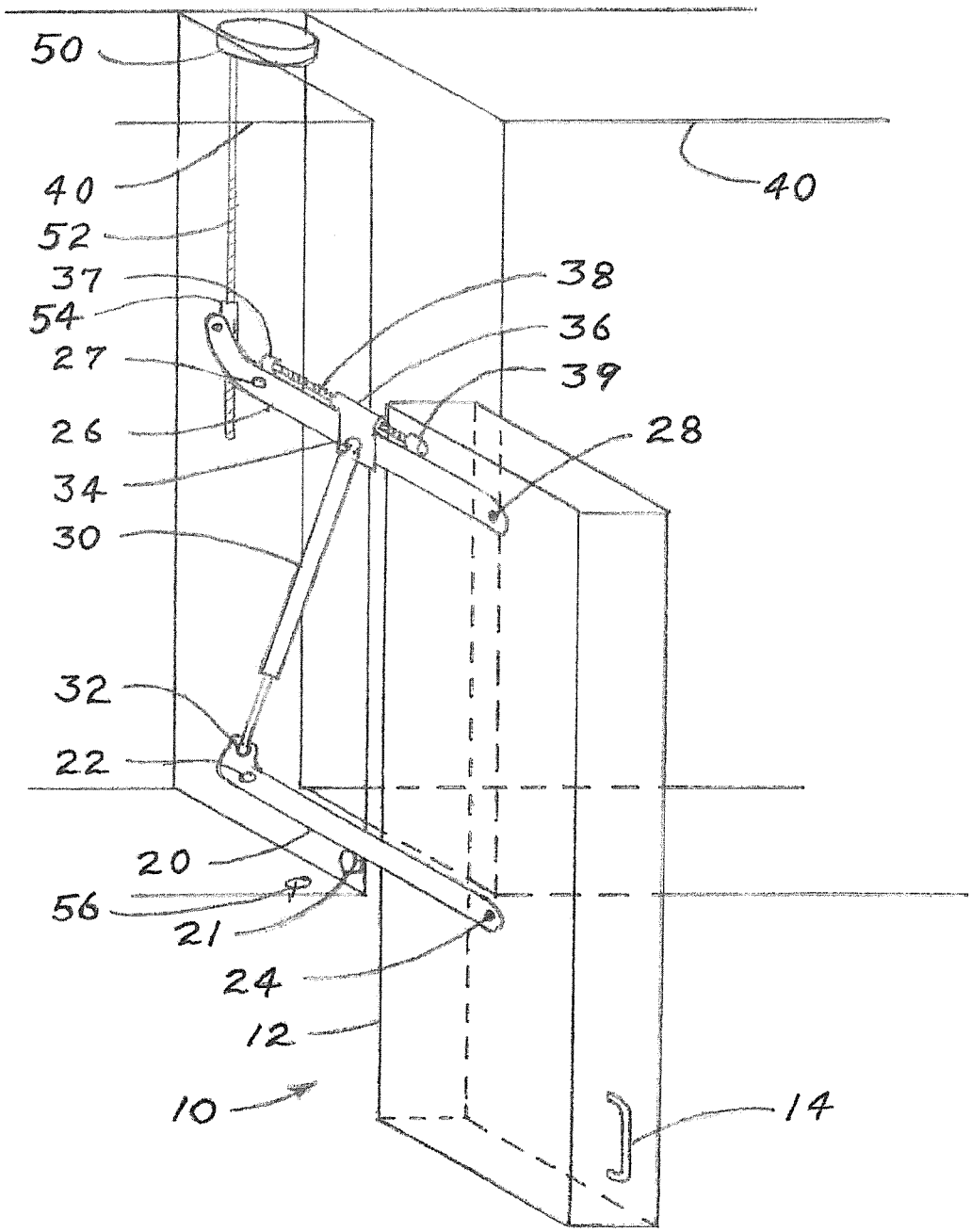
FIG. 9 is a front angled perspective view of an embodiment of a storage system in an open position using an electric actuator movement.
Figure 10:
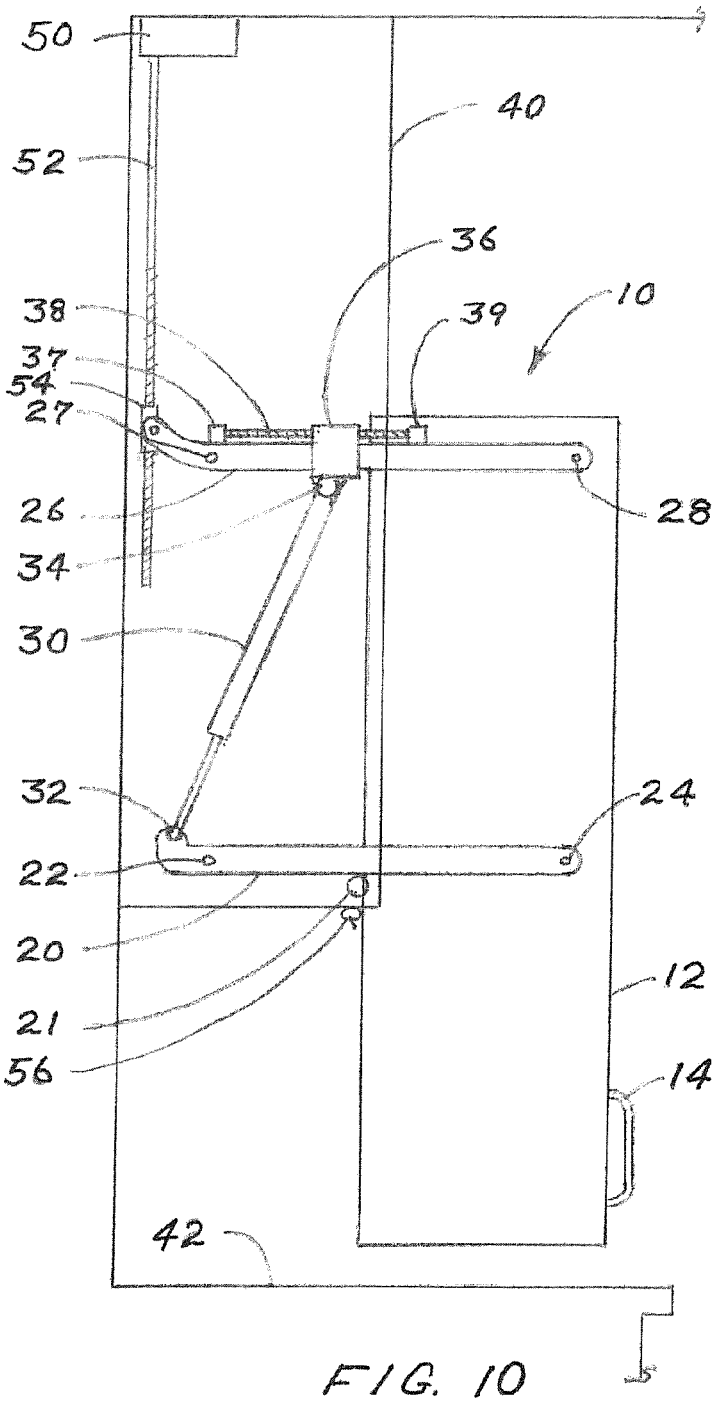
FIG. 10 is a side view of an embodiment of the storage system in an open position using an electric actuator movement.
Figure 11:
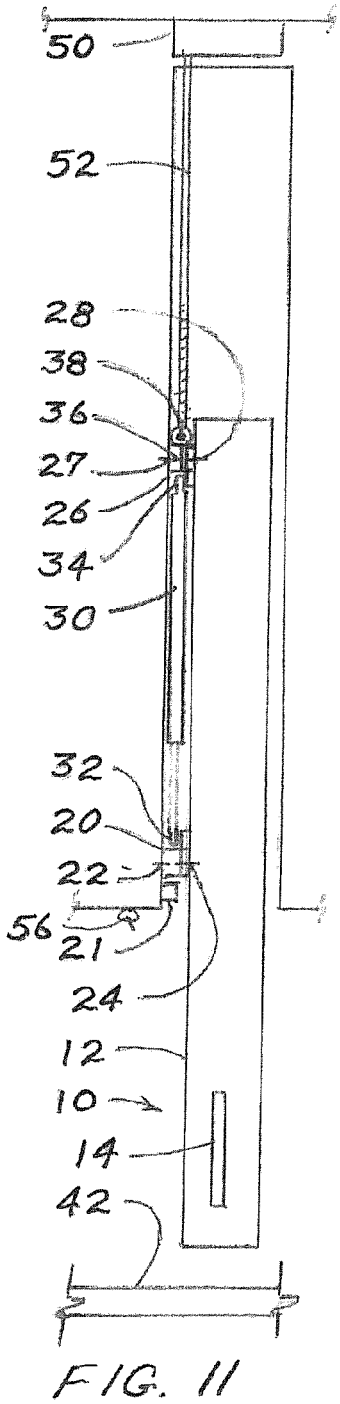
FIG. 11 is a front view of an embodiment of the storage system in the open position using an electric actuator movement.
Figure 12:
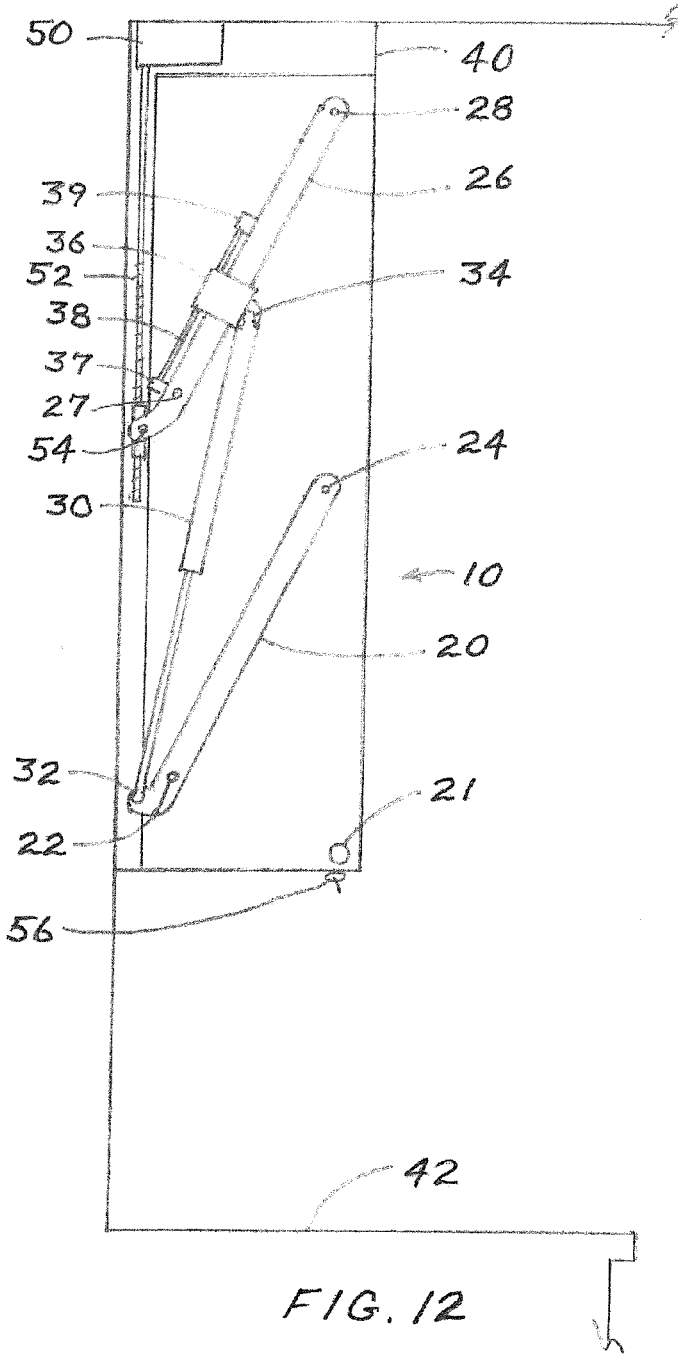
FIG. 12 is a side view of an embodiment of the storage system in a closed position using an electric actuator movement.
Figure 13:
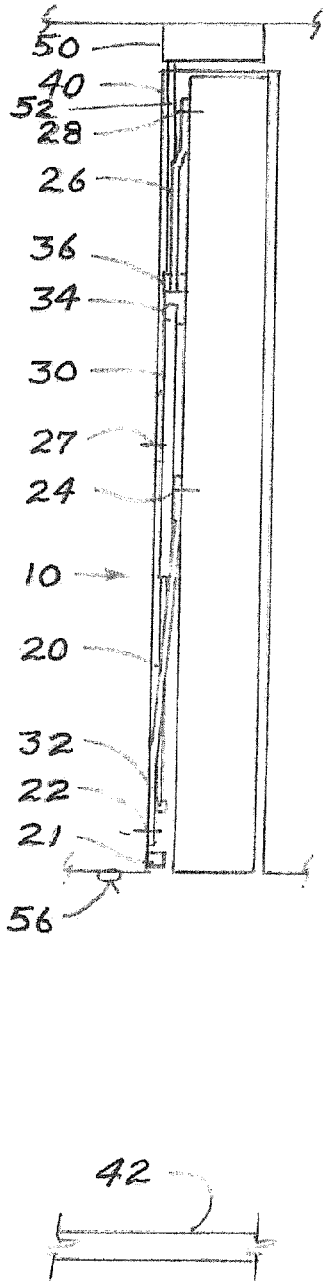
FIG. 13 is a front view of an embodiment of the storage system in the closed position using an electric actuator movement.

FIG. 6 illustrates an embodiment of the storage system 10. Specifically, the retractable vertical cabinet 12 can include a variety of different structures to house various contents. In this embodiment, the retractable vertical cabinet 12 includes a tray configuration 16 that may house structures to hold spices or other similar structures. Similarly, FIG. 8 illustrates an alternative embodiment of the retractable vertical cabinet 12. In this embodiment, the retractable vertical cabinet 12 is structured to house files in a folder holder configuration 18. In both cases, FIG. 7 illustrates the retractable vertical cabinet 12 in its retracted state.

As stated, the storage system 10 allows for making use of generally unusable or difficult to reach spaces. The system 10 allows for the storage and retrieval of contents in a manner that is easy and efficient without having to go through the hazardous and cumbersome techniques outlined herein.

An advantage of the storage system 10 is the lift assist mechanism 30. This mechanism balances the load present in the retractable vertical cabinet 12 and provides force to aid the user in pulling out and down, as well as pushing up and in, the retractable vertical cabinet 12, in a single motion.

A further advantage of the storage system 10 is the attachment of the lift assist mechanism 30 and the first and second pivoting support members, 20 and 26, to a side of the retractable vertical cabinet 12. This allows for retrieval of contents in spaces generally unusable in normal cabinetry without impeding access to stored contents.

Another advantage of the storage system 10 is the ability to accommodate various loads placed in the retractable vertical cabinet 12 by the user. This advantage is made possible by the lift adjuster 36 being threadably connected to the rotating adjustment screw 38. These features allow for the movement of the lift mechanism 30 along the second pivoting support member 26 resulting in various degrees of force exerted by the mechanism 30.

Another embodiment of the storage system 10 is the versatility that can be employed by the retractable vertical cabinet 12. As described above, FIGS. 6 and 8 illustrate a configuration of the retractable vertical cabinet 12 that can house various structures of food stuffs in a tray configuration 16. Alternatively, the retractable vertical cabinet 12 can house documents in a folder holder configuration 18. As such, the retractable vertical cabinet 12 can be constructed to house a multitude of items to be stored.

Although the foregoing invention has been described in some detail for purposes of clarity, it will be apparent that certain changes and modifications may be made without departing from the principles of the present invention. It should be noted that there are many alternative ways of implementing both the processes and apparatuses of the present invention. Accordingly, the present embodiments are to be considered as illustrative and not restrictive, and the invention is not to be limited to the specific details given herein.

Further, it will be understood that those skilled in the art, both now and in the future, may make various improvements and enhancements which fall within the scope of the claims which follow. These claims should be construed to maintain the proper protection for the invention first described.

What is claimed:

1. A storage system for storing contents, comprising:

a retractable vertical cabinet comprising a first and second side for storing contents;

at least a first and second pivoting support member, the at least first and second pivoting support members including at least a first and second end wherein the first end is pivotally attached to a support, housing, foundation or an adjacent cabinet, and the second end is pivotally attached to the first side of the retractable vertical cabinet, the second side, opposite to the first side, of the retractable vertical cabinet being accessible for storing contents;

a lift adjuster slidably housed on the second pivoting support member;

a rotating adjustment screw threadably connected to the lift adjuster, the rotating adjustment screw including first and second idlers on each end allowing for movement of the lift adjuster along the second pivot supporting member;

an electric actuator movement, the electric actuator movement comprising a motor mounted to the support, housing, foundation or adjacent cabinet, a swivel block connected to the second pivoting support member, a rotating threaded shaft connected to and driven by the motor, wherein the threaded shaft rotates through the swivel block;

a lift assist mechanism connected to the first pivoting support member and the lift adjuster on the second pivoting support member wherein the lift adjustor and lift assist mechanism provide for a change in leverage as the lift adjuster moves substantially towards the first or second end of the second pivoting support member providing assistance to the electric actuator movement in the movement of the retractable vertical cabinet in both vertical and horizontal directions from a stored to a deployed position allowing for the retrieval of stored contents and also from a deployed to a stored position.

2. The storage system of claim 1 including a stop attached to the support, located at a predefined distance from the first and second ends of the pivoting support members.

3. The storage system of claim 2 wherein the stop is made of plastic.

4. The storage system of claim 1 wherein the at least a first and second pivoting support members are comprised of metal.

5. The storage system of claim 1 wherein the retractable vertical cabinet is comprised of wood.

6. The storage system of claim 1 wherein the retractable vertical cabinet is comprised of sheet metal.

7. The storage system of claim 1 wherein the second side of the retractable vertical cabinet is in a tray configuration.

8. The storage system of claim 1 wherein the second side of the retractable vertical cabinet is in a file folder holder configuration.

9. The storage system of claim 1 wherein the retractable vertical cabinet includes at least a sidewall attached to the second side.

10. The storage system of claim 1 wherein the motor is connected to and activated by a switch.

* * * * *